United States Patent [19]

Baslow

[11] 4,094,076

[45] June 13, 1978

[54] FIXTURE FOR PORTABLE HAIR DRYER

[76] Inventor: Floyd M. Baslow, 100 Lafayette St., New Bethlehem, Pa. 16242

[21] Appl. No.: 743,469

[22] Filed: Nov. 19, 1976

[51] Int. Cl.[2] ..... F26B 19/00

[52] U.S. Cl. ..... 34/90; 34/151; 34/239; 34/243 R

[58] Field of Search ..... 34/90, 91, 103, 104, 34/151, 163, 239, 243 R; 248/75; 211/123; 219/369-371

[56] References Cited

U.S. PATENT DOCUMENTS

| | | | |
|---|---|---|---|
| 2,614,337 | 10/1952 | Darbo | 34/104 |
| 2,668,368 | 2/1954 | Jacobs | 34/151 |
| 2,856,700 | 10/1958 | Wales | 34/151 |
| 3,518,776 | 7/1970 | Wolff et al. | 34/99 |
| 3,835,869 | 9/1974 | Newman et al. | 34/97 |

FOREIGN PATENT DOCUMENTS

| | | | |
|---|---|---|---|
| 570,694 | 3/1930 | Germany | 34/99 |
| 466,897 | 2/1969 | Switzerland | 34/96 |

*Primary Examiner*—Kenneth W. Sprague
*Assistant Examiner*—James C. Yeung
*Attorney, Agent, or Firm*—Michael Ebert

[57] ABSTRACT

A fixture serving as a storage holster for a portable hair dryer and also functioning as a rack for drying towels and other fabric articles. The fixture which is mountable on a wall or attachable to an existing towel rack includes an upright holster section in the form of a tube whose upper end has an open socket formation adapted to receive and nest the nozzle of a portable hair dryer whereby the dryer may readily be removed from the holster for its intended use or stored thereon. Extending from the tube of the holster section and communicating therewith is a hollow rack section for supporting a towel or other article to be dried. The rack is provided with perforations to emit hot air jets when the socketed hair dryer is activated, thereby effecting drying of the article supported on the rack.

9 Claims, 4 Drawing Figures

10
11
12
13
14
15
16
17
17A
17B
18
19
20
21
22
23
24
25
26
27
28
29
30
31
32
33
34
35
S

FIXTURE FOR PORTABLE HAIR DRYER

BACKGROUND OF INVENTION

This invention relates generally to electrically-operated dryers wherein air is blown over a heated filament to produce a hot air stream, and more particularly to a fixture serving as a storage holster for a portable hair dryer and also functioning as a rack for drying towels and other articles.

The modern portable hair dryer is a highly useful appliance, for it is light-weight and easily manipulated by the user, making it possible to direct a stream of heated air onto the hair. The standard dryer includes an electrically-energized resistance-wire filament housed within a casing that also incorporates a blower motor which forces air through the filament into a tubular nozzle projecting from the casing. The electric power cord for the dryer passes through a handle attached to the casing and terminates in a plug.

Since it is the usual practice to use a portable hair dryer after shampooing the hair, one ordinarily stores this dryer in a bathroom cabinet when not in use. Before using the dryer, it is necessary to plug it into an electrical wall outlet. This practice may be hazardous; for if the user, after taking a shower and while still wet then proceeds to remove the dryer from the cabinet where it is stored and to plug it in, should the user be careless, he may make physical contact with the prongs of the plug and receive a serious electrical shock, particularly if the bathroom floor is also wet.

This danger can be avoided by keeping the dryer always plugged in, with its operating switch turned off. But in that event, the dryer would have to be laid, when not in use, on a bathroom counter or shelf, and this may be inconvenient.

Since bathrooms must be provided with towels, and the atmosphere of this room, because of the use to which it is put, is often quite humid, it is sometimes the practice in a modern bathroom to install a towel dryer in the form of a hollow towel rack supplied with heated air to dry the towels supported thereby. But this is not the only need for a dryer in a modern bathroom, for in this age of wash and wear clothing, it is the common practice to wash out a single garment in the wash basin with a view to wearing this garment shortly thereafter. While drip-dry clothing will dry out at a fairly rapid rate, say, in 2 or 3 hours, if the bathroom is used for this purpose, its humid atmosphere may slow down the drying process.

However, the drying of towels and clothing can be accelerated by means of hollow racks for supporting the fabrics which operate in conjunction with an electrical heater and motor-driven blower to force air through holes in the racks. Dryers of this type are disclosed in the Jacobs Pat. Nos. 2,668,368 and 2,835,049 as well as in the Glowacki patent 3,626,602. But such dryers are relatively cumbersome and preempt valuable space in a bathroom. Moreover, in bathrooms typically found in an apartment dwelling where space is at a premium, there is little room for rack dryers of the type heretofore known.

SUMMARY OF INVENTION

In view of the foregoing, it is the main object of this invention to provide a fixture serving as a storage holster for a portable hair dryer and also functioning as a rack for drying towels and other articles.

Among the salient features and advantages of the present invention are the following:

A. The fixture serves to support the portable hair dryer at a convenient position in readiness for normal use with its plug already inserted in a wall outlet. Thus the dryer is not stored in a bathroom cabinet or kept on a counter or shelf, nor need the plug be inserted before each use.

B. The same fixture functions to exploit the hair dryer as a hot-air source to supply heated air to a rack adapted to support a towel or an article of clothing.

C. The holstered hair dryer is also available at all times to defog bathroom mirrors.

More particularly, it is an object of this invention to provide a multi-purpose fixture of the above type which serves as a holster for any commercially-available portable hair dryer regardless of its nozzle configuration.

Briefly stated, these objects are attained in a fixture which is mountable on a wall or attachable to an existing towel rack, the fixture including an upright holster section in the form of a tube whose upper end has an open socket formation adapted to receive and nest the nozzle of a portable hair dryer. Extending from the tube and communicating therewith is a hollow rack section for supporting a towel or an article of clothing to be dried, the rack being provided with perforations to produce hot air jets when the socketed hair dryer is activated, to effect drying of the rack-supported article.

OUTLINE OF THE DRAWINGS

For a better understanding of the invention as well as other objects and further features thereof, reference is made to the following detailed description to be read in conjunction with the accompanying drawings, wherein.

DESCRIPTION OF INVENTION

First Embodiment

Figures 1, 2, 3, 4:
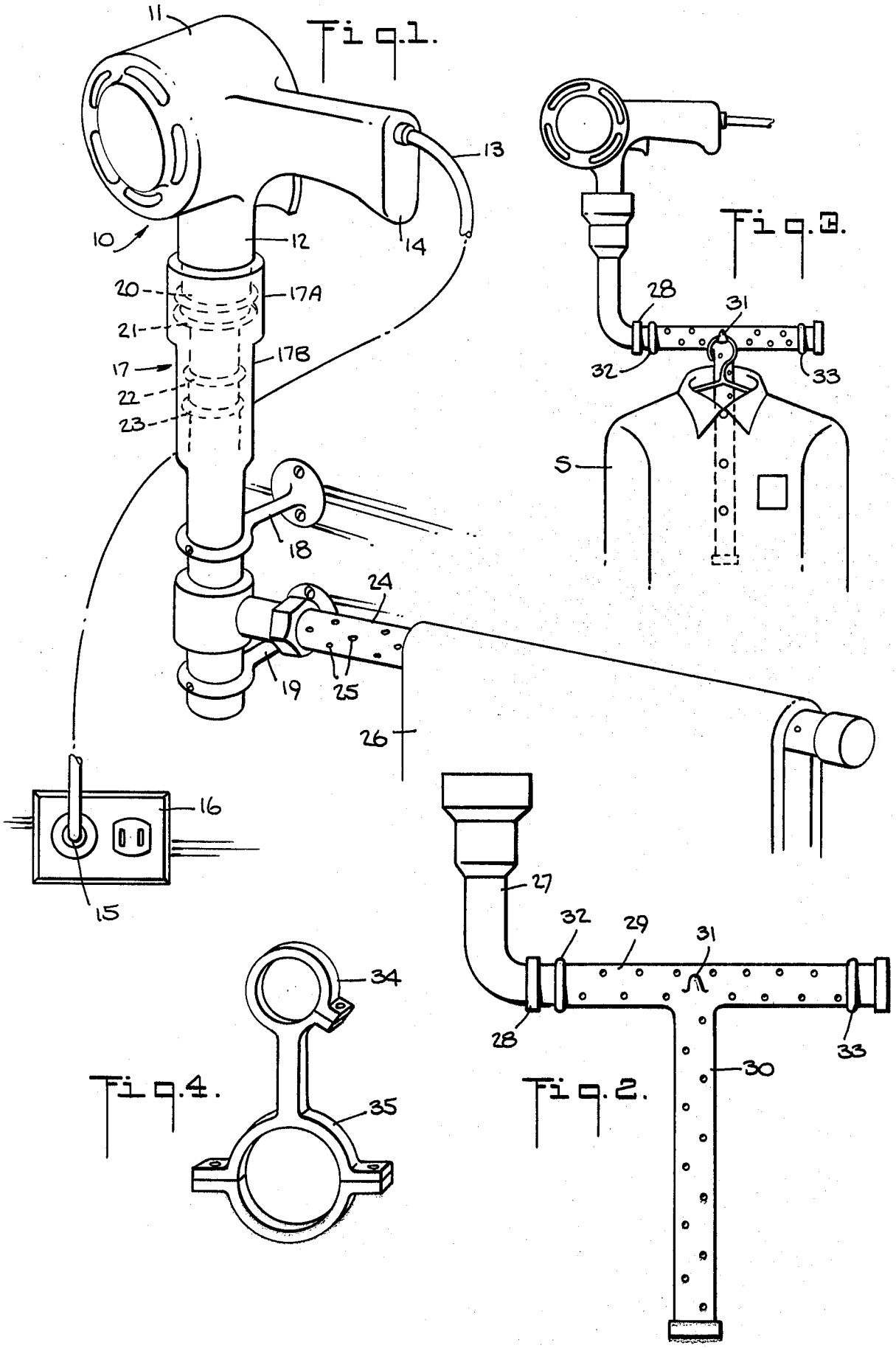
FIG. 1 is a perspective view of one preferred embodiment of a fixture in accordance with the invention.
FIG. 2 is an elevational view of another embodiment of the invention.
FIG. 3 shows the section of the fixture when in use to dry a shirt.
FIG. 4 illustrates a clamp for attaching the fixture to an existing towel rack.

Referring now to FIG. 1, there is shown a fixture in accordance with the invention adapted to cooperate with a standard portable hair dryer generally designated by numeral 10. Dryer 10 is constituted by a generally cylindrical casing 11 which houses an electrically-energized resistance-wire filament and a motor-operated blower for forcing air through the filament to generate a stream of hot air which is propelled through a tubular nozzle 12 projecting from the casing.

The electrical cord or line 13 for supplying power to the motor and filament extends through a handle 14 attached to the casing and terminates in a plug 15 which is insertable in a power outlet 16 mounted on the bathroom wall or wherever else the fixture is installed. The dryer is provided with an on-off switch S installed in the handle.

The fixture includes a holster section 17 which is supported in an upright position adjacent the wall at a suitable height thereon, the section being held on the wall by a pair of brackets 18 and 19. Holster section 17 is formed by a tube which is preferably of high-strength, synthetic plastic, non-conductive material, such as polycarbonate, the bottom end of the tube being closed.

The top end of the tube 17 has an open socket configuration formed by an upper zone 17A and an intermediate zone 17B, the internal diameter of the intermediate zone being greater than that of the body of tube 17 and the internal diameter of the upper zone being still greater. The upper zone is provided with a pair of spaced "O" rings 20 and 21 formed of resilient material mounted in annular grooves encircling the interior wall thereof. The intermediate zone is similarly provided with spaced "O" rings 22 and 23.

Existing commercial types of hair dryers come with nozzles of different diameter; hence the upper and intermediate zones are designed to match two existing nozzle sizes. Thus if the nozzle has a diameter that conforms to that of the intermediate zone, when inserted in the holster section, it will pass through the upper zone and be seated in the intermediate zone and engaged by the sealing rings therein whereby hot air emitted by the nozzle will be projected downwardly into the holster section and leakage thereof will be prevented. But if the nozzle is too thick to go into the intermediate zone, it will be nested in the upper zone of the holster section. In practice, the holster may have only a single zone to socket a particular size of hair dryer nozzle and removable adapters may be provided to accommodate the holster sockets to various other sizes of nozzles.

Welded or otherwise attached to the lower end of holster section 17 and extending laterally therefrom is a hollow rack section 24 having perforations 25 along the length thereof, the perforations being circumferentially distributed. The rack communicates with the interior of the holster section tube 17 at the junction thereof, the free end of the rack being closed.

Thus when the hair dryer is socketed in holster section 17 of the fixture, the hot air emitted therefrom is blown down the holster tube and passes through the rack where the hot air is ejected through the apertures 25 therein. The rack is long enough to support a towel 26 which when looped over the rack is subjected to the drying action of the ejected hot air.

The fixture in combination with the hair dryer facilitates several operating modes. When the dryer is not in use for any purpose, it is safely socketed in the holster of the fixture, the plug of the dryer cord being inserted in the wall outlet. This is the storage mode in which the fixture merely provides a convenient holder for the hair dryer so that it is readily accessible for use.

If now the user wishes to dry his wet hair, he simply removes the dryer from the holster and turns on switch S, for the dryer is already connected to the power outlet. Thus the user is not requested to plug in the dryer and there is no danger of shock. Or if the user wishes to defog a bathroom mirror, he carries the dryer toward the mirror and points the nozzle thereof toward the surface. The dryer power line should be long enough for this purpose. In some cases, it may be desirable to provide a retractable extension cord reel at the outlet, making it possible to carry the dryer to a fairly remote position.

When one desires to operate in the towel-drying mode, the dryer is kept in the holster, and switch S is turned on to produce hot air jets to dry a towel or any other fabric supported on the rack.

In some instances, one may wish to use the fixture only as a temporary expedient for exploiting a portable hair dryer to provide hot air to dry a freshly-washed article of clothing. For this purpose, the fixture may be provided with suction cups rather than brackets that must be screwed or otherwise attached to the wall, so that the fixture may be set up to carry out the drying action and then removed.

Second Embodiment

Referring now to FIGS. 2, 3 and 4, there is shown another embodiment of a fixture in accordance with the invention, which fixture is expressly designed to dry shirts as well as to afford a holster for a portable hair dryer. The fixture includes an upright holster tube section 27 whose open upper end is adapted to socket the nozzle of the dryer and whose open lower end has a right angle bend which is coupled by a threaded coupling ring 28 to one end of a hollow perforated rack piece 29. Piece 29 forms the horizontal portion of a T-shaped rack section that further includes a vertical perforated piece 30. The vertical piece 30 communicates with the horizontal piece which is attached thereto at its midpoint.

A hook 31 is secured to the junction or pieces 29 and 30 from which a clothes hanger may be suspended to support a shirt S as shown in FIG. 3. The fixture is mounted on the wall by ring brackets 32 and 33 which embrace the opposite ends of rack piece 29.

Vertical piece 30 projects within shirt S suspended from the rack, so that when the hair dryer is turned on, the hot air emitted from the apertures of horizontal piece 29 impinges on the exterior of the shirt while the hot air from vertical piece 30 impinges on the shirt interior to effect a very rapid drying action. Thus it is not necessary to reverse the shirt on the rack to expedite the drying action.

It may be desirable in some instances to mount the T-shaped rack piece on an existing towel rod in the bathroom rather than on the wall, particularly if only a temporary installation is preferred. For this purpose, one may use clamps of the type shown in FIG. 4 where the split ring section 34 is adapted to engage rack piece 29 and the two-part ring section 35 is provided with locking bolts making it possible to embrace and attach the clamp onto a wall-mounted towel rod.

While there have been shown preferred embodiments of a fixture for portable hair dryer in accordance with the invention, it will be appreciated that many changes and modifications may be made therein without, however, departing from the essential spirit thereof.

I claim:

1. A fixture adapted to cooperate with an electrically-operated portable hair dryer having a tubular nozzle from which a stream of hot air is emitted, said fixture serving as a storage holster for the hair dryer when it is not in use and as a fabric dryer for which the hair dryer supplies the necessary hot air, said fixture comprising:

A an upright holster section supported in an upright position against a wall and constituted by a rigid tube whose upper end is formed into an open socket for nesting the nozzle of the hair dryer in a manner causing substantially all of the hot air stream emitted from the nozzle to be projected into the tube, said holster holding said portable hair dryer in readiness for immediate withdrawal for drying hair, and B a hollow rack section attached to said holster section and communicating with the tube for supporting a fabric article to be dried, said rack section having perforations therein whereby when the hair dryer in the holster section is activated, the resultant stream of hot air is conducted by the holster section to the rack section and emitted through said perforations to provide hot air jets to dry the article.

2. A fixture as set forth in claim 1, wherein said socket is formed by an intermediate zone whose diameter is greater than the diameter of the body of the tube and an upper zone of still greater diameter whereby the socket is capable of nesting nozzles of different size.

3. A fixture as set forth in claim 1, wherein said socket is provided with resilient "O" rings to effect a seal between the nozzle and the socket surface to prevent leakage of hot air from the holster.

4. A fixture as set forth in claim 1, wherein said rack section is constituted by a hollow piece extending laterally from the tube and provided with perforations along its length and circumferentially.

5. A fixture as set forth in claim 4, further including mounting brackets coupled to the tube and attachable to a wall.

6. A fixture as set forth in claim 1, wherein said rack section has a T-formation formed by a hollow horizontal piece extending laterally from said tube and attached thereto, and a hollow vertical piece attached to the midpoint of said horizontal piece and communicating therewith.

7. A fixture as set forth in claim 6, further including a hook secured to said rack section at the junction of said pieces whereby a clothes hanger may be suspended therefrom.

8. A fixture as set forth in claim 6, further including mounting brackets coupled to the horizontal piece.

9. A fixture as set forth in claim 8, wherein said mounting brackets each include a two-part ring adapted to engage a rod whereby the fixture may be mounted on an existing towel rod.

* * * * *